United States Patent [19]

Portz

[11] 3,981,502

[45] Sept. 21, 1976

[54] YOKE FOR GAME RACKET

[75] Inventor: William E. Portz, North Madison, Ohio

[73] Assignee: True Temper Corporation, Cleveland, Ohio

[22] Filed: Aug. 21, 1975

[21] Appl. No.: 606,541

Related U.S. Application Data

[62] Division of Ser. No. 264,820, June 21, 1972, Pat. No. 3,908,995.

[52] U.S. Cl. ..... 273/73 G

[51] Int. Cl.[2] ..... A63B 49/02

[58] Field of Search ..... 273/73 R, 73 C, 73 D, 273/73 G, 73 H

[56] References Cited

UNITED STATES PATENTS

| | | | |
|---|---|---|---|
| 1,937,787 | 12/1973 | Robinson | 273/73 H |
| 1,942,479 | 1/1934 | Kleinman | 273/73 G |
| 3,664,669 | 5/1972 | Latham et al. | 273/73 G X |

FOREIGN PATENTS OR APPLICATIONS

| | | | |
|---|---|---|---|
| 736,167 | 9/1932 | France | 273/73 G |
| 1,578,059 | 8/1969 | France | 273/73 G |
| 228,650 | 2/1925 | United Kingdom | 273/73 H |

*Primary Examiner*—Richard J. Apley

[57] ABSTRACT

There is disclosed herein a tennis racket comprising a frame member shaped to provide a racket loop, a throat comprising convergent portions at one end of the loop, and a handle. A yoke is provided across the throat to close the loop, said yoke being of laminated construction and having laterally directed grip portions embracing the frame member on either side of the throat. Said yoke is adapted to mount a stringing insert.

11 Claims, 8 Drawing Figures

YOKE FOR GAME RACKET

This is a division of application Ser. No. 264,820, filed June 21, 1972 now United States Letters Pat. No. 3,908,995.

This invention refers to game rackets of the type used in tennis and badminton and particularly to a yoke or bridge adapted to be disposed at the throat of the racket.

Rackets of the type referred to which provide a network of highly tensioned strings as a striking surface are commonly constructed by shaping an elongated framing member in a single plane in such manner as to provide an oval-shaped loop with portions of the elongated member converging adjacent to one end of the loop to provide a throat, the end portions of the member coming together in a substantially parallel manner to provide a handle. This type of construction leaves one end of the striking loop open whereby the same ordinarily must be closed by a yoke or bridge. The yoke commonly comprises a separate length of the same material of which the rest of the frame is made. In other instances, an especially formed and fitted yoke member is inserted into the throat. Whatever form the yoke takes, its purpose is to close and strengthen the loop and provide some means at the throat or the open end of the loop for securing the ends of string running parallel with one dimension of the loop.

The present invention is adapted for use in a game racket constructed in the above described manner and is particularly adapted for use in a racket frame of metallic tubular construction although it is not necessarily limited thereto. The game racket of the present invention comprises an elongated member shaped to form a loop converging into a throat, a yoke being disposed across the throat whereby the loop is closed. The yoke engages said elongated member across said throat and has channel shaped gripping portions at either end overlapping and embracing a portion of the elongated member. String mounting means are carried by the elongated member and the yoke at the inner periphery of the loop by means of which strings means are tightly strung across said loop.

An object of the invention is to provide an improved yoke construction for use in a game racket.

A further object of this invention is to provide an improved yoke construction which overlaps and embraces portions of the racket across the throat of the racket.

A still further object of this invention is to provide an improved yoke construction of the above type which effectively closes the racket loop between the frame overlapping portions and securely mounts certain of the racket strings.

Still another object of this invention is to provide a yoke construction which can be readily detached and remounted to a game racket frame.

Yet another object of this invention is to provide, in a racket having individual string guide units, means for quickly and easily removing and replacing worn or broken units.

Yet another object of this invention is to provide a game racket yoke as set forth above which is simple and sturdy in construction and highly durable in use.

Other objects of the invention and the advantages thereof will become readily apparent from the following description of one embodiment of the invention shown in the accompanying drawings, in which said drawings.

Figure 1:
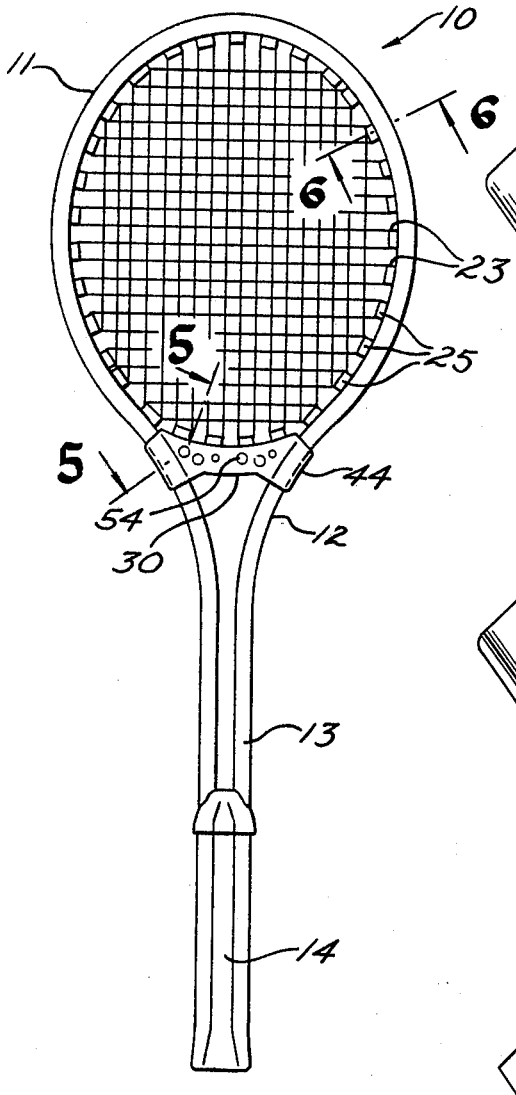
FIG. 1 is a front elevation of a game racket incorporating the yoke of this invention.
Figure 2:
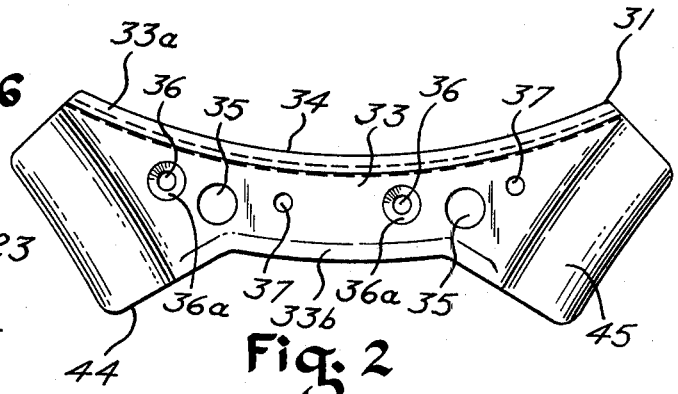
FIG. 2 is an enlarged outside plan view of a cover plate of the yoke of FIG. 1.

Referring now to the drawings in all of which like parts are designated by like reference numerals, FIG. 1 shows a tennis racket generally indicated by the numeral 10 formed of a single length of metal tube and comprising a loop 11, a convergent throat 12, and parallel shank portions 13 constituting a handle. The extreme distal end portion of the handle is preferably encased in a suitable handgrip portion 14 which may be of any suitable type and constitutes no part of the present invention.

Figure 5:
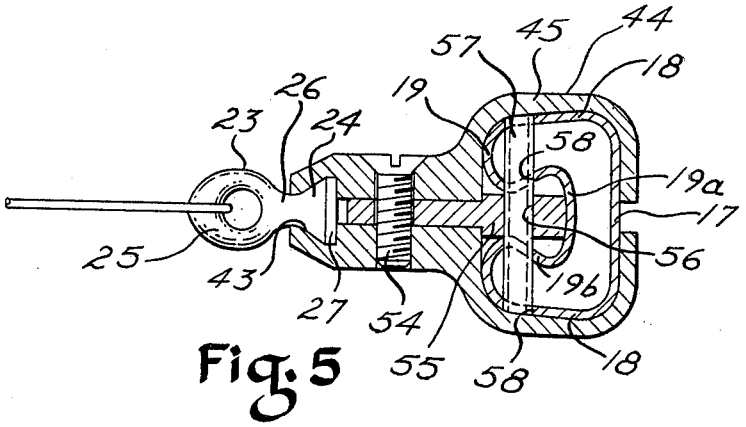
FIG. 5 is a section taken generally along the line 5—5 of FIG. 1 and greatly enlarged thereover.
Figure 6:
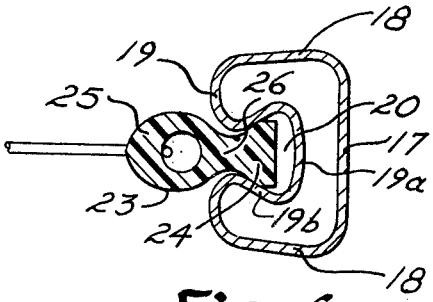
FIG. 6 is a section taken along the line 6—6 of FIG. 1 and greatly enlarged thereover.

Referring now particularly to FIGS. 5 and 6, the tubular framing as herein disclosed is generally rectangular in cross section having a smooth outer wall 17, inwardly slightly converging side walls 18, and an inner wall 19 formed to provide a continuous, inwardly expanded, dovetail shaped channel 20 defined by a recessed bottom wall portion **19*a* and inwardly converging recessed side wall portions 19*b* which are integral and continuous with the inner wall 19**. As illustrated, each wall portion curves gently into the adjacent wall portion.

Figure 7:
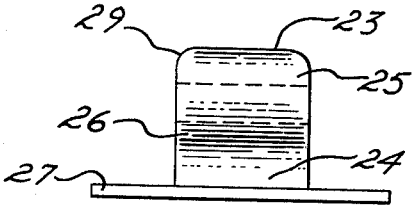
FIG. 7 is a side elevation on an enlarged scale of a string guide insert.

The dovetail recess 20 affords means for mounting string guide inserts 23 each of which has a base 24, the major portion of which is dovetail shaped in cross section whereby the same can be inserted into the recess 20 and slid to any selected position around the loop 11. Each string guide insert is preferably made from a sturdy plastic and includes an eyelet portion 25 which extends beyond the recess 20 inwardly of the loop 11 and is connected to said base 24 by a narrow neck portion 26. Each base 24 is provided with flat extensions 27 adapted to be disposed in and project parallel with the recess 20 and serve as a spacer means between said insert and a next adjacent insert. The flat extensions 27 are adapted to be trimmed to various lengths or eliminated altogether if necessary on one side or the other whereby to attain correct spacing of the inserts around the loop 11. Each eyelet portion 25 has an aperture 28 projecting all the way therethrough in a direction parallel with the recess 20 whereby all of said apertures are spaced just inwardly of the inner wall 19 of the loop 11. As shown in the side elevation of FIG. 7, the upper edges or corners of the insert 23 may be rounded as indicated at 29.

From the foregoing, it will be readily appreciated that any suitable number of string guide inserts 23 may be provided in the loop 11 by sliding the same endwise through the dovetail shaped channel 20 which will retain them in said loop 11. It will further be appreciated that said inserts 23 can be spaced closer together or further apart around the curvature of the loop to afford the desired geometric string pattern and that this spacing can be readily determined and maintained by varying the sizes of the flat extensions 27 of the insert bases 24.

Bridging the throat 12, thereby closing and completing the loop 11 at its lower end, is a yoke 30. As herein described, said yoke comprises a pair of identical metallic cover plates 31 and a centerpiece or spacer 32. Each cover plate 31 comprises a flat body portion 33 having an upper arcuate edge 34 so shaped as to close the open end of the loop 11. The outer surface of the body portion 33 may be beveled at the upper and lower edges thereof if desired as indicated at 33*a* and 33*b*, respectively.

The body portion 33 is provided with a pair of symmetrically laterally spaced apertures 35 so spaced as to be exactly aligned with like apertures of an oppositely facing cover plate. Said body portion 33 also has a pair of apertures 36 which are countersunk as indicated at 36*a* and which are laterally offset, each being disposed laterally of one of the symmetrical apertures 35, in the same direction. The body portion 33 is also provided with a pair of tapped holes 37 which are laterally offset in the opposite direction with respect to symmetrical apertures 35. The spacing is such that one aperture 36 is disposed symmetrically with one of the tapped holes 37 and the other aperture 36 is disposed symmetrically with respect to the other tapped hole 37. Thus it will be readily seen that when a pair of cover plates 31 are disposed with their inner, like surfaces facing each other, a screw placed through an aperture 36 will be aligned with and can be screwed into one of the tapped holes 37.

Figure 3:
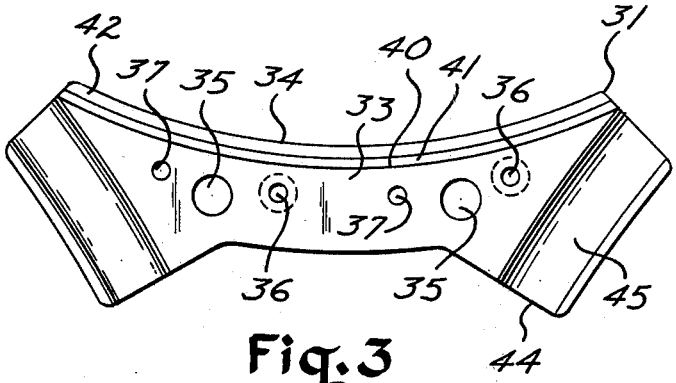
FIG. 3 is an inside plan view of the cover plate of FIG. 2.
Figure 4:
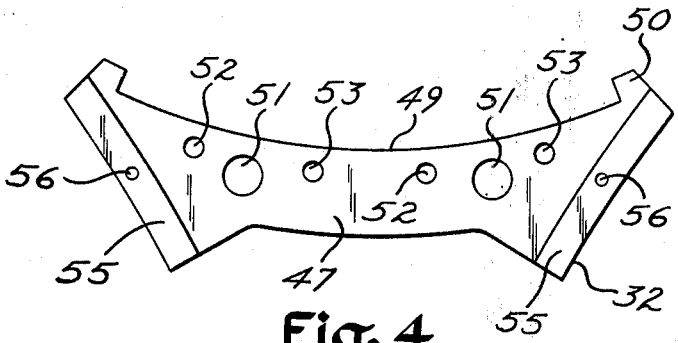
FIG. 4 is an enlarged plan view of a centerpiece of the yoke as seen from either side thereof.

Referring now particularly to FIG. 3 showing the inner surface of a cover plate 31, said cover plate is provided adjacent to the upper edge 34 thereof with a recess 40 having a flat bottom surface 41 and inwardly and upwardly inclined surfaces 42. Each recess 40 provides, in effect, one-half of a generally dovetail shaped channel 43 formed adjacent to the upper edges 34 when a pair of said cover plates are secured together with the centerpiece or spacer 32 disposed therebetween (FIG. 5).

At either laterally directed end of the body portion 33, each said cover plate is provided with grip portions 44 having laterally directed flanges 45 which are slightly arched in the plane of the cover plate to conform to the tubing forming the upper portion of the throat 12. As shown in FIG. 5, the flanges 45 are so shaped as to form a channel which fits exactly over the side walls 18 and portions of the outer and inner walls 17 and 19 of the framing whereby the yoke 30 is securely attached to the racket frame and the throat 12 is firmly maintained against widening or other distortions.

The centerpiece 32 comprises a central body portion 47 which is flat and has a major portion of its upper arcuate edge recessed downwardly as indicated at 49 whereby it is disposed slightly below the recesses 40 of the cover plate 31. A pair of upwardly converging tabs 50 are provided at either end of said recessed upper edge 49.

The body portion 47 is provided with a first pair of symmetrically arranged apertures 51 adapted to align with the apertures 35 of the cover plate 31. Said body portion 47 also has asymmetric pairs of apertures 52 and 53 corresponding in position to the pairs of apertures 36 and the pair of tapered holes 37, respectively, whereby screws 54 can pass therethrough when securing a pair of cover plates 31 together (FIG. 5).

Figure 8:
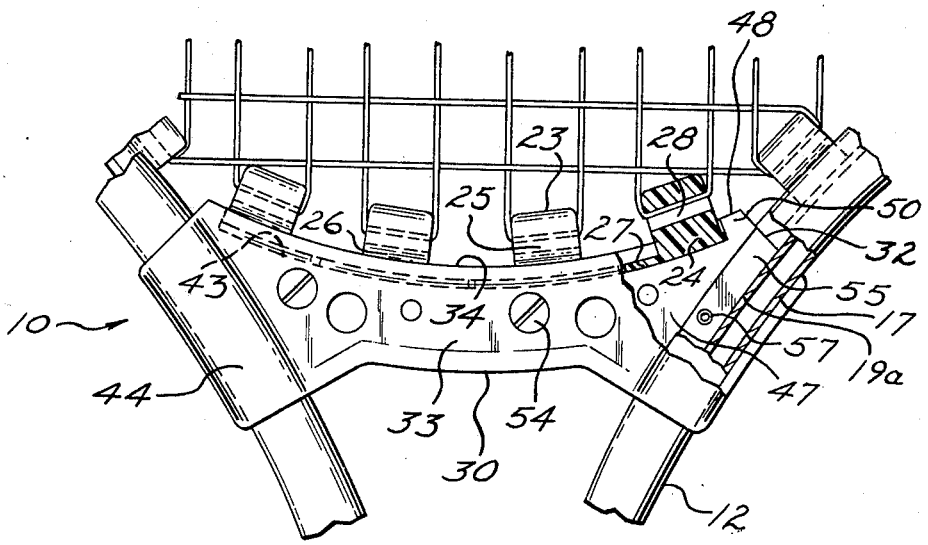
FIG. 8 is an enlarged detail of the yoke of FIG. 1, portions being broken away or shown in section for greater clarity.

The laterally directed ends of the body portion 47 of the centerpiece 32 are provided with slightly arcuate thickened portions 55 each having an aperture 56 therein. As shown in FIG. 5, the thickened portions 55 are adapted to seat in the dovetail shaped channel 20 of the frame and are secured in place by pins 57 which project through the apertures 56 and suitable apertures 58 in the tubing wall. The grip portions 44 of the cover plates 31 overlie the ends of the pins 57 thus retaining them in position. With said cover plates secured together by the screws 54 on either side of the centerpiece 32, the dovetail shaped channel 43 is thus formed whereby the same will retain a plurality of the string guide inserts 23. As shown in FIG. 8, in the embodiment herein illustrated, the right-hand string guide insert 23 has had most of the right-hand flat extension 27 removed whereby the same abuts closely adjacent to the right-hand tab 50 to maintain its desired position. The tabs 50 retain the string guide inserts 23 of the yoke 30 against endwise movement within the groove 43.

From the foregoing it will be readily seen that the present invention provides improved yoke means for a game racket which rigidly secures the frame members across the racket throat and effectively closes and completes the racket loop. An improved laminated yoke is provided which is readily detachable for quickly and easily removing and replacing worn or broken string guide inserts at the time of restringing. The yoke firmly grips the racket at the curved portion of the throat by providing channel shaped grip portions overlapping the racket framing member and being so secured thereto as to give the frame and loop great rigidity and impact strength.

It will be understood that many changes in the details of the invention as herein described and illustrated may be made without, however, departing from the spirit thereof or the scope of the appended claims.

I claim:

1. A game racket comprising an elongated frame member formed into a loop, converging portions forming a throat, and handle portions extending beyond said throat, said racket having a longitudinal axis; said loop having means for mounting strings thereto; a yoke connecting said converging portions across said throat; said yoke comprising a pair of complementary plate members having body portions disposed parallel with the plane of said loop; grip portions disposed at the ends of said body portions affording converging channels opening toward each other and nested over said converging portions; said body portions having edge portions closing said loop extending between said grip portions; a flat spacer of substantially the same shape as said body portions disposed between said body portions; said edge portions of said body portion having means for mounting strings thereto; and means securing said body portions and spacer together whereby said grip portions firmly engage said converging portions.

2. A game racket as set forth in claim 1 wherein said converging portions have inner surfaces directed toward said axis and said inner surfaces have recess means therein; said spacer having lateral end portions extending into said recess means at either side of said throat; and means for securing said end portions to said converging portions.

3. A game racket as set forth in claim 2 wherein said means for securing said end portions comprises pins projecting through said converging portions and end portions within said grip portions whereby said grip portions overlie the ends of said pins and retain said pins against endwise displacement.

4. A game racket comprising an elongated frame member formed into a loop, converging portions forming a throat, and handle portions extending beyond said throat, said racket having a longitudinal axis; said loop having string mounting means associated therewith; a yoke connecting said converging portions across said throat; said converging portions having inner surfaces directed toward said axis, outer surfaces directed away from said axis, and substantially parallel front and rear surfaces; said yoke comprising a pair of complementary plate members having body portions disposed parallel with the plane of said loop; grip portions disposed at the ends of said body portions affording converging channels opening toward each other and nested over said converging portions; said body portions having edge portions closing said loop extending between said grip portions; a flat spacer of substantially the same shape as said body portions disposed between said body portions; inner surfaces of said edge portions affording complementary portions of a dovetail shaped channel opening inwardly of said loop and having inner side walls converging toward the opening thereof, the edge of said spacer adjacent to said loop being recessed to at least substantially the depth of said dovetail shaped channel; string guide inserts having bases of substantially dovetail shape disposed and retained in said channel; said inserts having string receiving portions extending inwardly of said loop; and means securing said body portions and spacer together whereby said grip portions firmly engage said converging portions.

5. A game racket as set forth in claim 4 wherein said spacer has tabs disposed at the ends of said recessed upper edge thereof, said tabs projecting toward said loop and into end portions of said dovetail shaped channel thereby retaining said string guide inserts within said channel.

6. A game racket as set forth in claim 4 wherein said frame member has recess means opening at said inner surfaces of said converging portions; said spacer having lateral end portions extending into said recess means at either side of said throat; and means for securing said end portions to said converging portions.

7. A game racket as set forth in claim 6 wherein said means for securing said end portions comprises pins projecting through said converging portions and end portions within said grip portions whereby said grip portions overlie the ends of said pins and retain said pins against endwise displacement.

8. A game racket comprising elongated frame means providing a loop and converging portions forming a throat; means affording a handle extending beyond said throat; a yoke disposed parallel with the plane of said loop and connecting said converging portions of said elongated frame means across said throat; said yoke comprising laterally outwardly facing grip portions adapted to engage said converging portions; said grip portions having laterally directed flange portions which at least partially overlap said converging portions and define channels whereby said converging portions nest snugly within said grip portions; means whereby said grip portions securely engage said converging portions; means rigidly connecting said grip portions to each other across said throat including means providing an arcuate bridge portion closing and completing said loop and providing string mounting means at said throat; said yoke comprising at least two plate members engaging said converging portions from front and back, respectively, of the plane of said loop and having said grip portions at either laterally directed end; means securing said plate members to each other; said yoke including a spacer disposed between said plate members, said means securing said plate members to each other projecting through said spacer.

9. A game racket having convergent elongated frame portions forming a throat at one end of a racket loop, said game racket having a yoke construction bridging said throat comprising laterally outwardly facing grip portions adapted to engage said convergent frame portions; said grip portions having laterally directed flange portions which at least partially overlap said convergent frame portions and define channels whereby said convergent frame portions nest snugly within said grip portions; means whereby said grip portions securely engage said convergent frame portions; means rigidly connecting said grip portions to each other across said throat including means providing an arcuate bridge portion closing and completing the racket loop; said yoke construction comprising a pair of plate members engaging said convergent frame portions from front and back, respectively, of the plane of the loop and having said grip portions at either laterally directed end; means securing said plate members to each other; said plate members having like, concavely curved upper edges extending across the throat; inner surface portions of said plate members adjacent to said upper edges being formed to provide complementary portions of a dovetail shaped channel which opens inwardly of said loop and has side walls which converge toward the opening thereof; a spacer disposed between said plate members, the upper edge of said spacer being recessed to at least substantially the depth of said dovetail shaped channel formed by said plate members; string mounting means comprising string guide inserts having bases of the same cross-sectional shape as said dovetail shaped channel whereby said inserts are retained in said dovetail shaped channel; and said inserts having string receiving portions extending inwardly of the loop.

10. A game racket as set forth in claim 9: there being a plurality of string guide inserts in said dovetail shaped channel; said spacer having tabs disposed at the ends of said recessed upper edge thereof, said tabs projecting inwardly and retaining said string guide insert against endwise movement within said dovetail shaped channel.

11. A game racket as set forth in claim 10 wherein the elongated frame portions forming the throat have inwardly opening channels therein; said spacer having end portions adapted to extend into said last mentioned channels at either side of the throat; and means for securing said extended end portions and the elongated frame portions.

* * * * *